US012167772B2

(12) United States Patent
Casali et al.

(10) Patent No.: US 12,167,772 B2
(45) Date of Patent: Dec. 17, 2024

(54) VENTILATED SHOESOLE

(71) Applicant: WAHU S.R.L., Milan (IT)

(72) Inventors: Patrizia Casali, Milan (IT); Marco Armellini, Sondalo (IT); Mattia De Santis, Tribiano (IT); Fanny Boria, Milan (IT); Paolo Lovati, Cassinetta di Lugagnano (IT)

(73) Assignee: WAHU S.R.L., Milan (IT)

( * ) Notice: Subject to any disclaimer, the term of this patent is extended or adjusted under 35 U.S.C. 154(b) by 195 days.

(21) Appl. No.: 17/790,345

(22) PCT Filed: Dec. 23, 2020

(86) PCT No.: PCT/IB2020/062394
§ 371 (c)(1),
(2) Date: Jun. 30, 2022

(87) PCT Pub. No.: WO2021/137114
PCT Pub. Date: Jul. 8, 2021

(65) Prior Publication Data

US 2023/0055680 A1 Feb. 23, 2023

(30) Foreign Application Priority Data

Jan. 3, 2020 (IT) ..... IT102020000000055

(51) Int. Cl.
*A43B 7/083* (2022.01)
*A43B 3/34* (2022.01)
(Continued)

(52) U.S. Cl.
CPC ..... *A43B 7/083* (2022.01); *A43B 3/34* (2022.01); *A43B 7/10* (2013.01); *A43B 13/12* (2013.01); *A43B 13/203* (2013.01); *A43B 13/206* (2013.01)

(58) Field of Classification Search
None
See application file for complete search history.

(56) References Cited

U.S. PATENT DOCUMENTS 5,813,142 A 9/1998 Demon
5,860,225 A * 1/1999 O'Dwyer ..... A43B 7/02 36/35 B (Continued)

FOREIGN PATENT DOCUMENTS

CN 203723523 U 7/2014
DE 202015103131 U1 6/2015

(Continued)

OTHER PUBLICATIONS

International Search Report and Written Opinion for Corresponding International Application No. PCT/IB2020/062394, 13 pages, Apr. 9, 2021.

*Primary Examiner* — Jameson D Collier
(74) *Attorney, Agent, or Firm* — LUCAS & MERCANTI, LLP

(57) ABSTRACT

A sole for footwear and footwear including the sole wherein the sole includes a first layer having a plurality of orifices passing through and configured to be connected to an upper of a footwear article and to form an inner environment of the footwear, and a second layer coupled to the first layer, having a plurality of chambers and one or more channels or passages fluidly connecting the orifices and chambers. The sole also includes a pressurization device in fluid communication with the channels or passages and is configured to increase the air pressure in the plurality of chambers and regulating valves in fluid communication with the channels or passages to regulate a pressure in the plurality of chambers.

10 Claims, 15 Drawing Sheets

(51) Int. Cl.

| | |
|---|---|
| ***A43B 7/10*** | (2022.01) |
| ***A43B 13/12*** | (2006.01) |
| ***A43B 13/20*** | (2006.01) |

(56) References Cited

U.S. PATENT DOCUMENTS

| | | | | |
|---|---|---|---|---|
| 5,893,219 | A * | 4/1999 | Smith | A43B 7/081 36/3 R |
| 5,953,835 | A | 9/1999 | Kwon | |
| 2004/0078996 | A1* | 4/2004 | Brooks | A43B 7/144 36/3 R |
| 2009/0113762 | A1 | 5/2009 | Leimer et al. | |
| 2010/0005687 | A1* | 1/2010 | Ramadoro (An) | A43B 3/0042 36/29 |
| 2010/0186256 | A1 | 7/2010 | Farina et al. | |
| 2014/0283413 | A1* | 9/2014 | Christensen | A43B 13/20 36/102 |
| 2018/0289097 | A1* | 10/2018 | Gong | A43B 3/00 |

FOREIGN PATENT DOCUMENTS

| | | | |
|---|---|---|---|
| EP | 3202275 | A1 | 8/2017 |
| JP | 3122264 | U | 6/2006 |
| JP | 2014087585 | A | 5/2014 |
| JP | 2015513422 | A | 5/2015 |
| KR | 20140131622 | A | 11/2014 |
| WO | 2015101366 | A1 | 7/2015 |
| WO | 2019050628 | A1 | 3/2019 |

* cited by examiner

VENTILATED SHOESOLE

CROSS-REFERENCE TO RELATED APPLICATIONS

This application is a 371 of PCT/IB2020/062394, filed Dec. 23, 2020, which claims the benefit of Italian Patent Application No. 102020000000055, filed Jan. 3, 2020.

FIELD OF THE INVENTION

The present disclosure refers in general to the sector of footwear manufacturing, and more particularly relates to a sole for footwear provided with a ventilation system for the ventilation of a footwear, as well as a footwear comprising this sole. The present disclosure also relates to a ventilation method for ventilating the inner environment of a footwear.

BACKGROUND OF THE INVENTION

It is known that while wearing a closed footwear, the foot generates heat and sweat which generally manage to be expelled through the upper and the sole, due to the permeability to air and water vapour of the material used to make these latter ones. However, in subjects predisposed to excessive sweating or during dynamic activities, such as sports, the heat and sweat produced cannot be drained through the upper and/or sole. The result is an accumulation of heat and humidity within the footwear, to a higher or lesser extent depending on the permeability to air and water vapour of the materials used to make the upper and the sole, which determines an uncomfortable and unhealthy microclimate inside the footwear. In fact, the accumulation of sweat and heat in the inner environment of the footwear negatively affects the comfort and hygiene of the footwear and of the foot itself and causes discomfort, persistent bad odors and, sometimes, the onset of pathologies.

In particular, the foot sole, having a high density of sweat glands compared to other body regions, is the most subject one to the production of sweat. In addition, the friction between the foot sole and the inner surface of the sole generates the production of heat at the interface between the foot sole and the sole. Therefore, the interface between the foot sole and the sole generally appears to be the area of the footwear wherein there is a greater accumulation of heat and stagnation of moisture from perspiration.

Consequently, it is important for a footwear to ensure proper heat and water vapour exchange between the inner environment of the footwear and the external environment, especially in the interface region between the foot sole and the sole. Footwear with a sole capable of allowing a certain transpiration or ventilation of the region of the interface between the foot sole and the sole itself are known. However, known footwear with ventilating sole are not able to allow adjustment of ventilation or transpiration depending on the user's needs. In the context of the prior art, the venting of the air contained within the inner environment of the footwear is constant and the ventilation or transpiration through the sole cannot be adjusted depending on the real user's needs. Therefore, known footwear with a ventilating sole are not able to respond in real time to the user's needs for transpiration or ventilation.

SUMMARY OF THE INVENTION

The present disclosure aims to provide a sole for footwear which allows to overcome the aforementioned drawbacks with reference to the prior art and/or to achieve further advantages.

Therefore, the main purpose of the subject of the present disclosure is to provide a sole for footwear capable of ensuring better draining of sweat and heat than the soles of known breathable footwear.

This is achieved through a footwear sole and a footwear comprising such sole as defined in the respective independent claims. Also the subject of this disclosure is a ventilation method for ventilating the inner environment of a footwear. Secondary characteristics and particular embodiments of the subject of this disclosure are defined in the corresponding dependent claims.

The present disclosure originates from the acknowledgment of the authors of the present disclosure that the known capacity for transpiration and/or ventilation is a fixed capacity, that is to say constant and not modifiable, while it is possible to adapt or regulate this capacity depending on or in response to the user's needs.

According to the present disclosure, the sole comprises a first layer, having a plurality of through orifices and configured to be connected to an upper of a footwear and to form an inner environment of the footwear, and a second layer, coupled to said first layer and comprising a plurality of chambers. In addition, the sole comprises one or more channels, or passages, which fluidically connect said plurality of orifices and said plurality of chambers, a pressurization device, in fluid communication with said one or more channels or passages and configured to increase an air pressure in said plurality of chambers; and, finally, it comprises one or more regulating valves, in fluid communication with said one or more channels, or passages, configured to regulate a pressure in said plurality of chambers.

In other words, the sole according to the present disclosure is provided with one or more channels putting in fluid communication the orifices present in the first layer, or innermost layer, of the footwear and said plurality of chambers in the second layer and with a pressurization device which, connected to one or more connection channels, is apt to suck air from said orifices and supply it to said chambers. In addition, the sole according to the present disclosure also comprises one or more chamber pressure regulating valves. The regulating valves are configured, that is, to selectively allow the air supplied to the chambers to be retained or to discharge the air stored inside the chambers. The regulating valves are configured, that is, to allow an adjustment of the fluid communication between the plurality of orifices and the plurality of chambers. The air discharged from the chambers can be conveyed, through said one or more channels or passages, one again back into the inner environment of the footwear.

If necessary, therefore, the pressurization device can be activated to remove or move away moisture and hot air from the inner environment of the footwear. In other words, the pressurization device is apt to create or generate a flow or passage of air between the orifices located at with the first layer, i.e. the innermost layer of the sole, and the plurality of chambers. In other words, by means of the pressurization device it is possible to generate an air return from the inner environment of the footwear to the plurality of chambers in the second layer of the sole. In this way, therefore, the heat and humidity generated by the user's foot can be removed from the inner environment of the footwear. Furthermore, to compensate for the reduction in pressure within the inner environment of the footwear, air from the outside of the footwear is drawn back into said environment. It therefore follows an increased cooling and ventilation effect due to the entry of air from the outside of the footwear. The pressurization device is therefore to be understood as a feeding device which conveys or supplies an air flow or fluid towards the inner chambers.

Furthermore, if necessary, it is possible to activate the regulating valves. The regulating valves are apt to further determine or adjust the pressure within the plurality of chambers. The regulating valves are apt to be opened or closed to define the quantity of air, respectively, exiting the plurality of chambers or retained within the plurality of chambers. The regulating valves are therefore configured to create, if necessary, a discharge of the air present in the plurality of chambers and therefore to create a reverse flow or passage of air or fluid from the plurality of chambers, through the one or more channels and the plurality of orifices, to the inner environment of the footwear. In use, the regulating valves are therefore configured to create, as needed, an air flow from the plurality of chambers to the inner environment of the footwear. Said air flow skims the user's foot, generating a cooling effect.

According to a preferred aspect of the present disclosure, said pressurization device and said one or more regulating valves are configured to control the air flow from said plurality of orifices to said plurality of chambers and vice versa, between a dynamic ventilation condition and at least a static condition; and wherein in said dynamic ventilation condition, said pressurization device and said one or more regulating valves are configured to allow the passage of air between said plurality of orifices and said plurality of chambers and vice versa; and wherein in said at least one static condition, said one or more regulating valves are configured to prevent or impede a passage of air between said plurality of chambers and said plurality of orifices.

In other words, according to this preferred aspect, the pressurization device and the one or more regulating valves are apt to determine the presence or substantial lack of an air flow between plurality of orifices to said plurality of chambers and vice versa. That is to say that, selectively or if necessary, the pressurization device and one or more regulating valves can be activated to generate a ventilation effect within the inner environment of the footwear. In particular, in said at least one static condition, the pressurization device and the one or more regulating valves are configured to prevent fluid communication between the inner environment of the footwear and the plurality of chambers.

According to a preferred aspect, said dynamic condition can be a direct ventilation condition or a reverse ventilation condition; wherein in said direct ventilation condition, said pressurization device is configured to suck air through said plurality of orifices and supply it to the plurality of chambers and said one or more regulating valves are configured to allow the passage of air from said plurality of orifices to said plurality of chambers; and wherein in said reverse ventilation condition, said one or more regulating valves are configured to allow a return of air from said plurality of chambers to said plurality of orifices. In other words, the pressurization device and the one or more regulating valves are apt to generate a flow or passage of air in a first direction, between the plurality of orifices and the plurality of chambers, and in a second direction, opposite in the first direction, between the plurality of chambers and the plurality of orifices. That is to say that the pressurization device and the one or more regulating valves are configured to generate an air passage between the inner environment of the footwear and the plurality of chambers and vice versa. As needed or if necessary, the air can be picked up from the inner environment of the footwear and supplied to the plurality of chambers, and, again as needed or if necessary, the air can be re-sent from the plurality of chambers to the inner environment.

According to a preferred aspect of the present disclosure, in said reverse ventilation condition, said one or more regulating valves are configured to allow a complete or maximum air passage from said plurality of chambers to said plurality of orifices. That is to say that in said reverse ventilation condition, the regulating valves are configured to allow complete venting of the air present within the plurality of chambers. In other words, the regulating valves are apt to completely open the fluid communication with the one or more channels, and therefore with the one or more orifices. Therefore, all the air present within the plurality of chambers can be sent to the inner environment of the footwear, generating a cooling effect.

According to a preferred aspect of the present disclosure, said static condition is a first static condition and in said first static condition the pressure inside the plurality of chambers is greater than the atmospheric pressure; and also said pressurization device and said one or more regulating valves are configured to control the air flow from said plurality of orifices to said plurality of chambers and vice versa, between a dynamic ventilation condition and a second static condition, wherein the air pressure inside the plurality of chambers is substantially equal to the atmospheric pressure. In the first static condition, the air stored within the plurality of chambers is at a pressure higher than atmospheric pressure and the regulating valves are configured to prevent a discharge or return of the air contained within said chambers. That is to say that in the first static condition, the regulating valves are configured to maintain a pressure higher than atmospheric pressure within the plurality of chambers. In the second static condition, however, the air pressure within the plurality of chambers is substantially equal to the atmospheric pressure, and therefore equal to the pressure within the inner environment of the footwear.

According to a preferred aspect of the present disclosure, in said first static condition, the plurality of chambers has a first volume and, in said second static condition, the plurality of chambers has a second volume which is smaller than said first volume. In other words, in the first static condition the plurality of chambers occupies a larger volume than the volume occupied by the plurality of chambers in the second static condition. Stated otherwise, in the condition wherein the pressure within the plurality of chambers is at a value higher than the atmospheric pressure, the plurality of chambers is capable of assuming an "inflated" configuration, while, in the condition wherein the pressure within the plurality of chambers is equal to atmospheric pressure, the plurality of chambers is capable of assuming a "deflated" configuration. The plurality of chambers is therefore a plurality of expandable chambers.

According to a preferred aspect of the present disclosure, the sole has a support surface, i.e. a surface apt, in use, to face towards or be placed in contact with a walking surface. Furthermore, according to this preferred aspect, the second layer defines at least part of said resting surface. It follows that part of the supporting surface is formed by the second layer of the sole. Still according to this same preferred aspect, in the second static condition, said support surface is substantially flat, and wherein in said first static condition said support surface has or forms an asperity, at each chamber of said plurality of chambers, which in use protrudes towards said walking surface. In other words, the second layer forms, at least in part, the resting surface of the sole and is also able to determine the configuration of this surface. In fact, according to this preferred aspect, the second layer is able to modify, depending on the volume reached by the plurality of chambers, the conformation of the support surface of the sole. Therefore, advantageously, by adjusting the air pressure within the plurality of chambers, it is also possible to vary the configuration of the support surface of the sole. In particular, it is possible to vary or modify the configuration of the sole between a flat configuration, wherein the pressure within a plurality of chambers is at a pressure equal to the atmospheric one, and a configuration presenting asperities or protuberances, facing the walking surface, wherein the pressure within plurality of chambers is at a pressure higher than atmospheric one. Therefore, through the sole of this disclosure, it is possible not only to intervene as needed on the ventilation inside the footwear but also to modify the support surface, for example to obtain greater grip or stability on uneven or rough ground. In fact, the protrusions on the supporting surface act as studs.

According to a preferred aspect of the present disclosure, the chambers of said plurality of chambers are distributed at a first end region of the sole and a second end region of the sole and said one or more regulating valves comprise a first valve, configured for opening or closing the fluid communication between said one or more channels or passages and each chamber of the plurality of chambers in the first end region of the sole, and a second valve, configured to open or close the fluid communication between said one or more channels or passages and each chamber of the plurality of chambers in the second end region of the sole. In other words, the chambers of the plurality of chambers are defined in the second layer at a first region of the sole and a second region of the sole, such as for example a first end region, or heel, and a second end region, or toe. Furthermore, the fluid communication, i.e. the passage of air, between the plurality of orifices and said first and second regions is regulated respectively by a first regulating valve and by a second regulating valve. It follows that the first regulating valve and the second regulating valve are configured to allow regulating also selectively the passage of fluid with said first and second regions. Therefore, advantageously, also the configuration of the support surface of the sole can be changed if necessary, by activating said first regulating valve and/or said second regulating valve. For example, if said first region corresponds to a heel region and said second region corresponds to a toe region of the sole, it is possible for the support surface to assume a different conformation between heel and toe. Specifically, this is particularly advantageous, because in use on a steep walking surface, depending on the uphill or downhill direction, it is possible to obtain, if desired, a sole with protrusions, or studs, at the heel region or the toe region of the sole.

According to a preferred aspect of the present disclosure, the sole may further comprise a timer connected to said one or more regulating valves and/or to said pressurization device and wherein said timer is configured or programmed to control the opening/closing of said one or more regulating valves at predetermined time intervals and/or for controlling the activation of said pressurisation device at predetermined time intervals. In other words, the sole can be provided with a timer, or time switch, configured to open or close one or more regulating valves at predetermined time intervals and/or to activate the pressurization device at predetermined time intervals. This is particularly useful when it is known the average time employed by, i.e. necessary for, the plurality of chambers to take or reach a certain volume, for example a maximum volume, such as for example at the end of a direct ventilation condition. In fact, knowing this time, it is possible, for example, to open at least one regulating valve when the plurality of chambers has reached its maximum volume or after a certain period of time from reaching the maximum volume.

According to a preferred aspect of the present disclosure, the sole can further comprise a pressure sensor, apt to detect a pressure within the plurality of chambers, and a control unit, connected to said pressure sensor and to said one or more regulating valves, and wherein said control unit is configured or programmed to control the closing or opening of said at least one regulating valve if the pressure detected by the pressure sensor reaches a certain pressure threshold. In other words, the sole can be provided with a pressure sensor for detecting a pressure within each chamber of the plurality of chambers and with a control unit connected to said pressure sensor and presenting a certain threshold value for the pressure within the chambers of the plurality of chambers stored in a memory. In addition, according to this aspect, the control unit is connected to at least one regulating valve and is configured or programmed to control its activation, i.e. the closing or the opening, upon detection of a pressure equal to the threshold pressure. In other words, the control unit is configured or programmed to interrupt or open the fluid communication upon reaching a pressure equal to the certain threshold pressure within each chamber.

According to a further preferred aspect, said control unit is also connected to said pressurization device and is configured or programmed to control the activation of the latter. In other words, the control unit is configured or programmed to activate or deactivate the pressurization device. In particular, the control unit is, for example, apt to interrupt the operation of the pressurization device upon reaching a threshold pressure within the plurality of chambers.

According to a preferred aspect of the present disclosure, the pressurization device is positioned at an end region of the sole. That is, the pressurization device is arranged or housed in an end region, such as a toe or heel region of the sole. In this way, the pressurization device does not affect the flexibility of the sole, does not hinder during the walking and it is easily accessible, for example, for carrying out maintenance operations, by a user.

Finally, according to another preferred aspect of the present disclosure, the sole also comprises a temperature sensor and/or a humidity sensor associated with said first layer. The temperature sensor and/or the humidity sensor are configured to measure or detect, respectively, the temperature or humidity within the inner environment of the footwear and are connected to the control unit. The control unit is programmed or configured to activate the pressurization device upon reaching a certain temperature and/or humidity threshold. That is to say that depending on the temperature and/or humidity detected, by means of said temperature sensor and/or said humidity sensor, the control unit is therefore apt to control the pressurization device. In other words, upon reaching a certain temperature and/or humidity threshold within the inner environment of the footwear, the control unit is configured to control the activation of the pressurization device to withdraw air and water vapour and remove it from said inner environment. It follows that the sole allows to always ensure optimal conditions, in terms of temperature and/or humidity, within the inner environment of the footwear without requiring manual activation by a user.

The present disclosure also relates to a footwear comprising a sole according to a preferred aspect of the present disclosure, the footwear comprising a sole, as briefly defined above. In particular, footwear also comprises an upper, associated with the sole to define an inner environment of the footwear. This inner environment of the footwear is apt, in use, to house a user's foot. According to a preferred aspect, moreover, the footwear comprises a temperature sensor and/or a humidity sensor associated with said upper to respectively detect the temperature and humidity within said inner environment. The control unit is connected to said temperature sensor and/or said humidity sensor and is programmed or configured to activate the pressurization device upon reaching a certain temperature and/or humidity threshold within the inner environment. The control unit can also be connected to the at least one regulating valve and be configured so as to control the opening or closing of the latter one/ones depending on the temperature and/or humidity reached within the inner environment. In particular, the control unit can be configured to open or close at least one regulating valve once the aforementioned temperature and/or humidity threshold has been reached within the inner environment.

Finally, a ventilation method for ventilating the inner environment of a footwear is also part of this disclosure.

The method for ventilating the inner environment of a footwear, according to this disclosure, includes a step of:

- providing an upper,
- providing a first layer of sole, having a plurality of through orifices,
- connecting said first layer of sole to said upper to form said inner environment,
- providing a second layer of sole, comprising a plurality of chambers,
- coupling said second layer to said first layer,
- fluidly connecting said plurality of orifices and said plurality of chambers through one or more channels or passages between said plurality of orifices and said plurality of chambers,
- providing a pressurization device,
- placing said pressurization device in fluid communication with said one or more channels or passages,
- providing one or more regulating valves,
- putting said one or more regulating valves in fluid communication with said one or more channels or passages,
- creating and adjusting a passage or air flow between said plurality of orifices and said plurality of chambers, or vice versa.

In other words, through the aforementioned method it is possible to create and adjust an air passage between the inner environment of the footwear and the plurality of chambers and vice versa. In this way, it is possible to selectively generate two air flows so as to obtain a ventilation effect within the inner environment of the footwear.

According to a preferred aspect of the present disclosure, the step of adjusting or controlling a passage or air flow between said plurality of orifices and said plurality of chambers comprises:

- sucking air through said plurality of orifices by means of said pressurization device,
- supplying said air through said one or more channels or passages and said one or more regulating valves to the plurality of chambers,
- increase the air pressure within said plurality of chambers,
- prevent a return of air through said one or more regulating valves,
- allowing a return or passage of air through said one or more regulating valves towards the plurality of orifices.

In particular, according to a further preferred aspect, the step of allowing a return or passage of air through said one or more regulating valves, the return or passage is a complete or maximum passage of air from said plurality of chambers to said plurality of orifices. That is, there is a complete or total emptying of the chambers of the plurality of chambers. All the air that is contained within the plurality of chambers, due to the pressure difference, returns to the inner environment of the footwear.

In addition, according to a preferred aspect, the method can comprise the steps of: measuring the time, opening and/or closing said one or more regulating valves at predetermined time intervals and/or controlling the activation of said pressurization device at predetermined time intervals. It follows that, periodically, the method may provide for allowing or preventing fluid communication between the plurality of chambers and the plurality of orifices.

According to a further preferred aspect, the method can comprise the steps of: detecting a pressure within said plurality of chambers, defining a pressure threshold, controlling the closing and/or opening of said one or more regulating valves if the detected pressure reaches this certain pressure threshold. It follows that, depending on the pressure within the plurality of chambers, the method may allow or prevent fluid communication between the plurality of chambers and the plurality of orifices. Furthermore, according to this same aspect, the method can also include a step of controlling the activation of said pressurization device depending on the measured pressure. Therefore, the method allows to determine, depending on the pressure reached by the plurality of chambers, a determined static or dynamic ventilation condition of the sole, and therefore of the footwear.

Finally, according to a further preferred aspect, the method provides for the steps of: detecting the temperature and/or humidity within said inner environment, defining a temperature and/or humidity threshold, controlling the activation of said pressurization device and/or open or close said one or more regulating valves upon reaching the predetermined temperature and/or humidity threshold. It follows that the method allows to determine, depending on the temperature and/or humidity within the inner environment, a specific ventilation condition, static or dynamic, of the sole and thus of the footwear.

Further advantages, characteristic features and modes of use forming the subject of the present disclosure will become clear from the following detailed description of embodiments thereof, provided by way of a non-limiting example. It is evident, however, that each embodiment forming the subject of the present disclosure may have one or more of the advantages listed above; in any case it is not required that each embodiment should have simultaneously all the advantages listed.

BRIEF DESCRIPTION OF THE DRAWINGS

Reference will be made to the figures of the attached drawings, wherein.

DETAILED DESCRIPTION OF THE INVENTION

Figure 1:
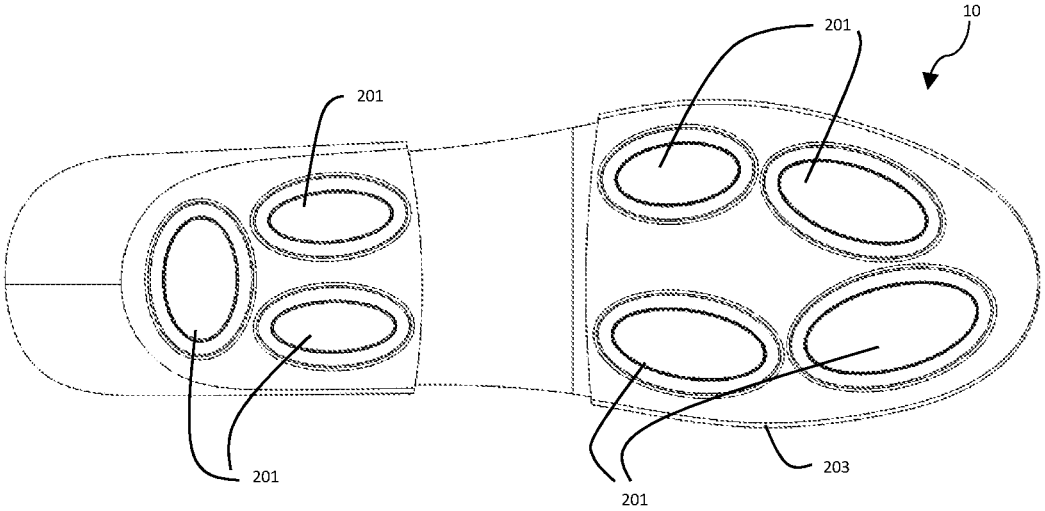
FIG. 1 is a bottom view of a sole according to an aspect of the present disclosure.
Figure 2:
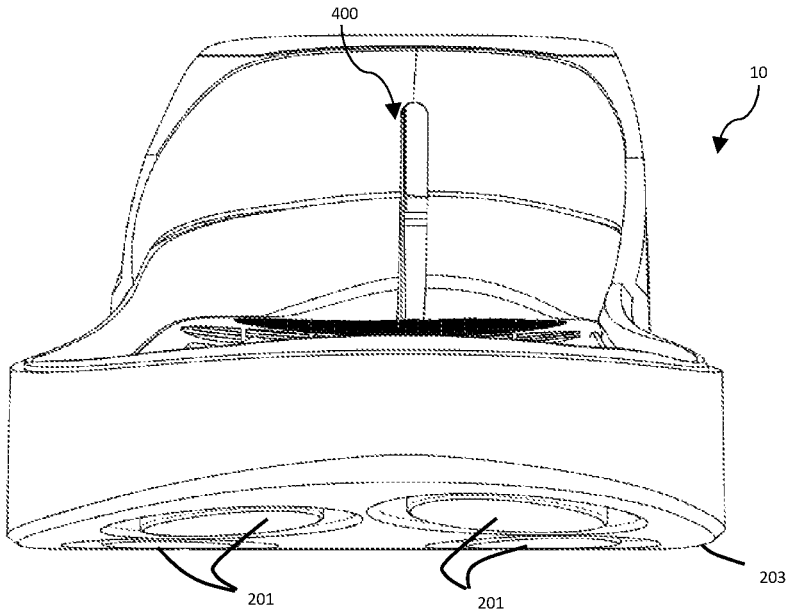
FIG. 2 is a front view of a sole according to an aspect of the present disclosure, without the first layer.
Figure 3:
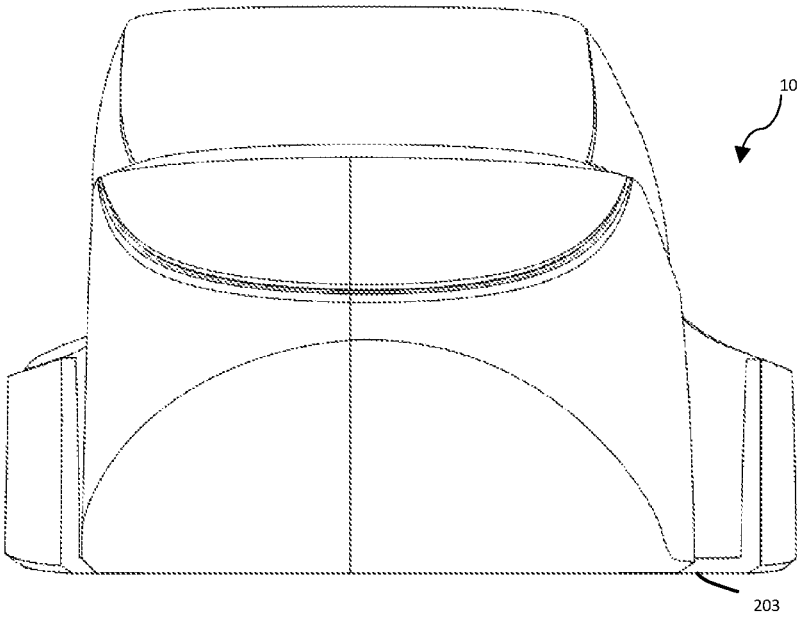
FIG. 3 shows a rear view of a sole according to an aspect of the present disclosure.
Figure 4:
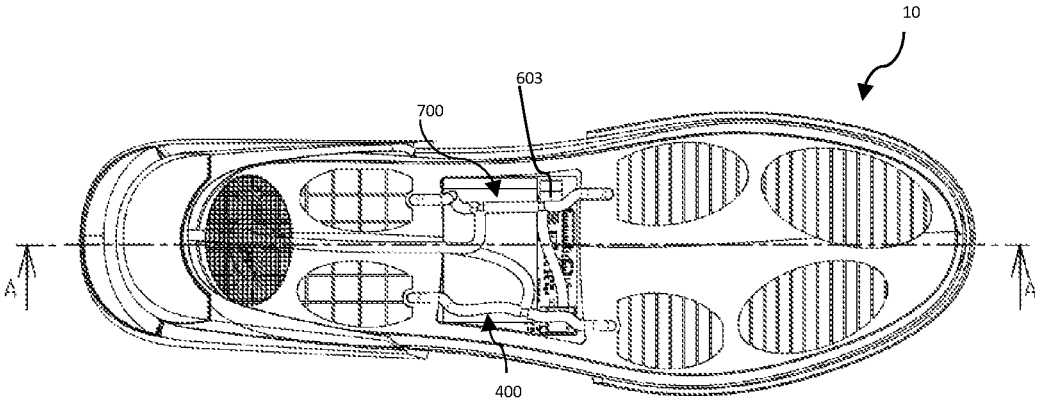
FIG. 4 shows a top view of a sole according to an aspect of the present disclosure, without the first layer.
Figure 5:
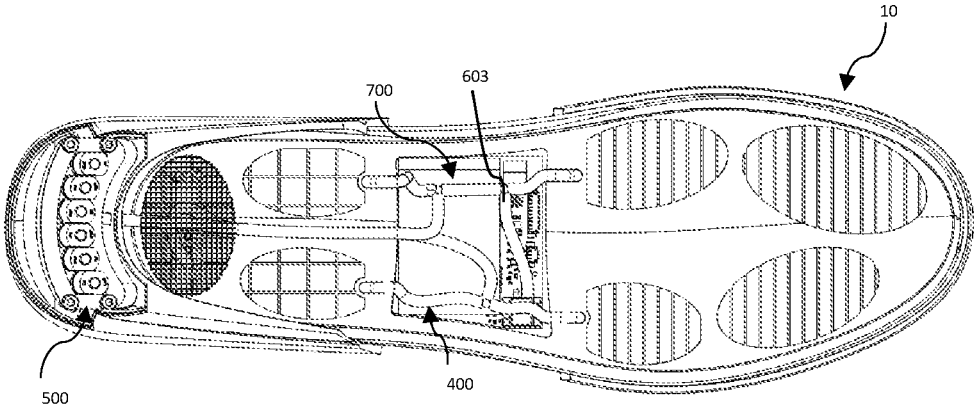
FIG. 5 shows a longitudinal sectional view of the sole shown in FIG. 4.
Figure 6:
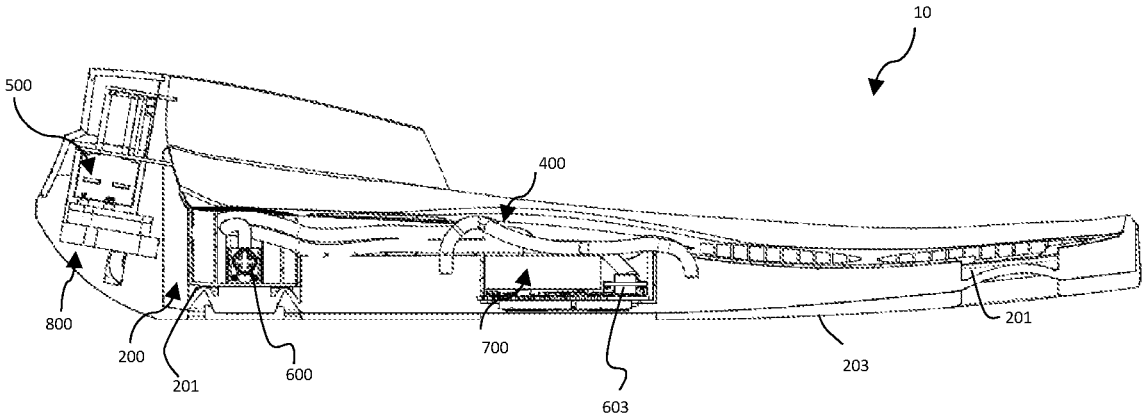
FIG. 6 shows a sectional view along the line A-A of the sole shown in FIG. 4.
Figure 7:
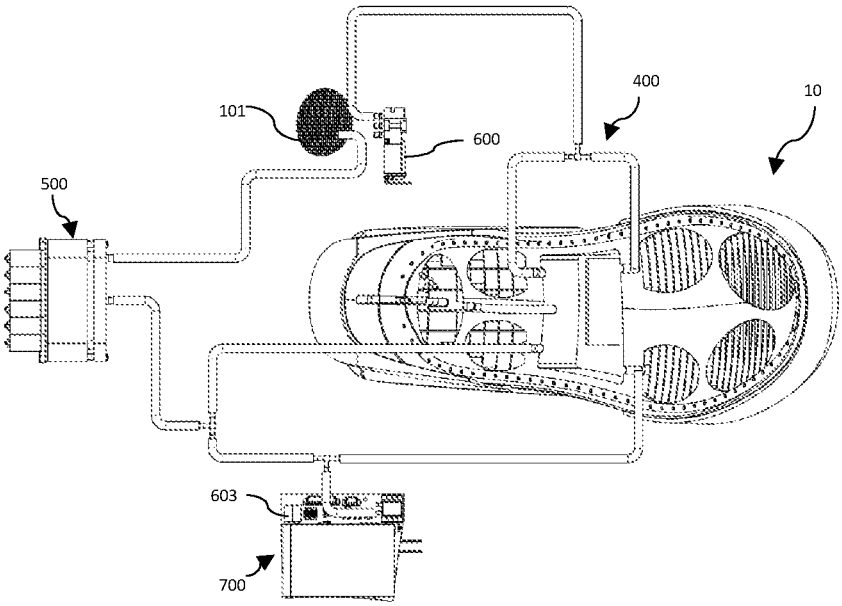
FIG. 7 shows an exploded schematic view of the sole shown in FIG. 4.
Figure 8:
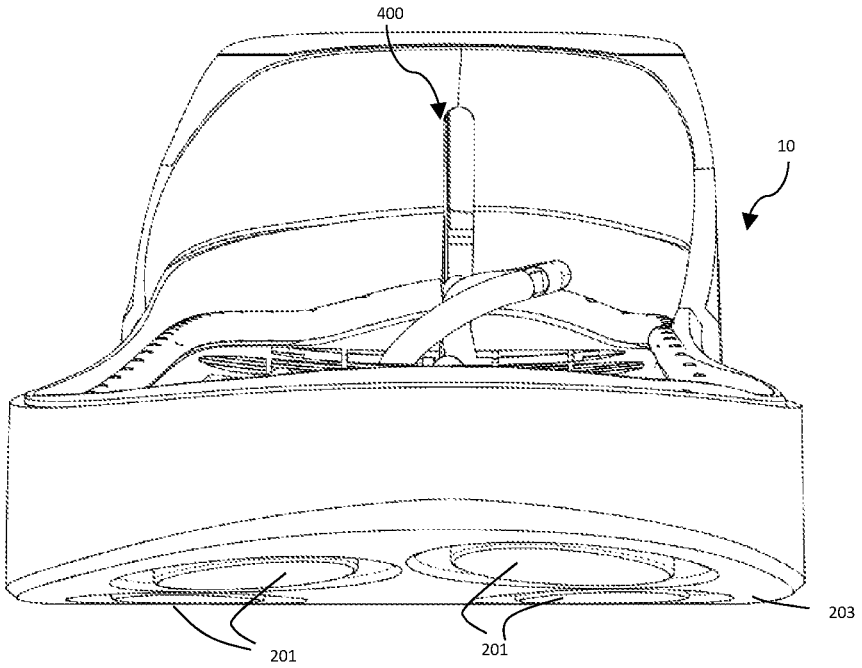
FIG. 8 shows a front view of a sole according to an aspect of the present disclosure, without the first layer.
Figure 9:
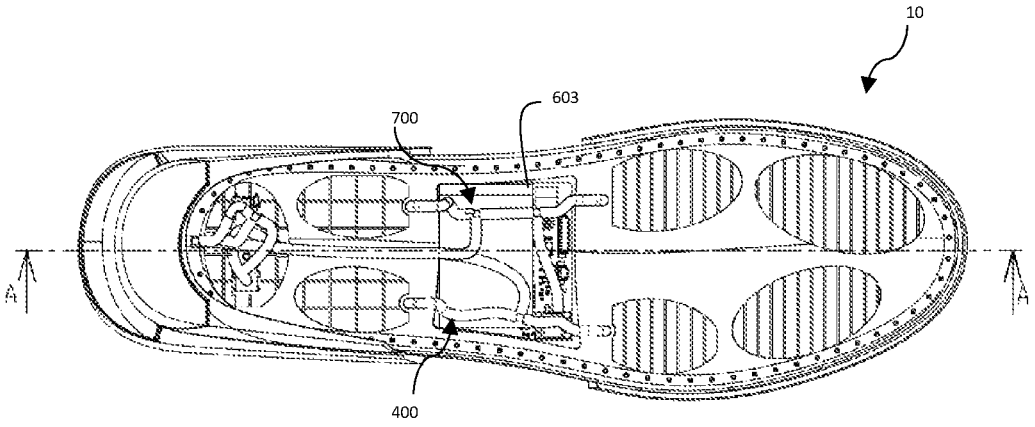
FIG. 9 shows a top view of a sole according to an aspect of the present disclosure, without the first layer.
Figure 10:
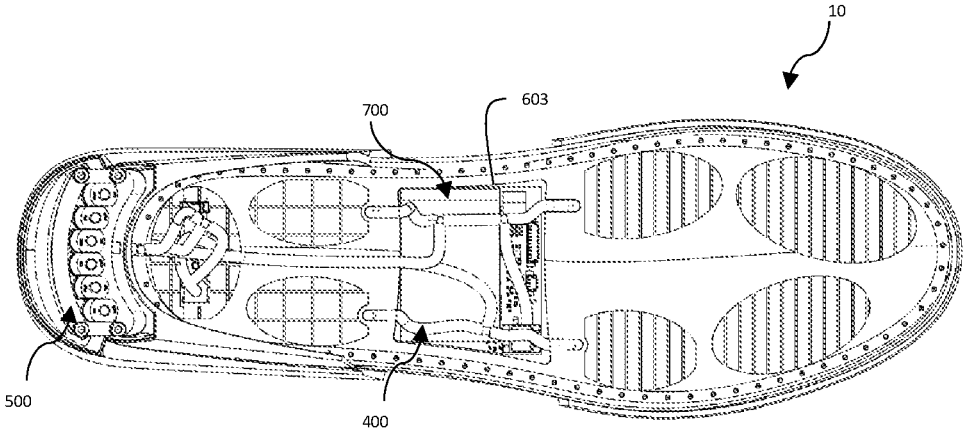
FIG. 10 shows a longitudinal sectional view of the sole shown in FIG. 9.
Figure 11:
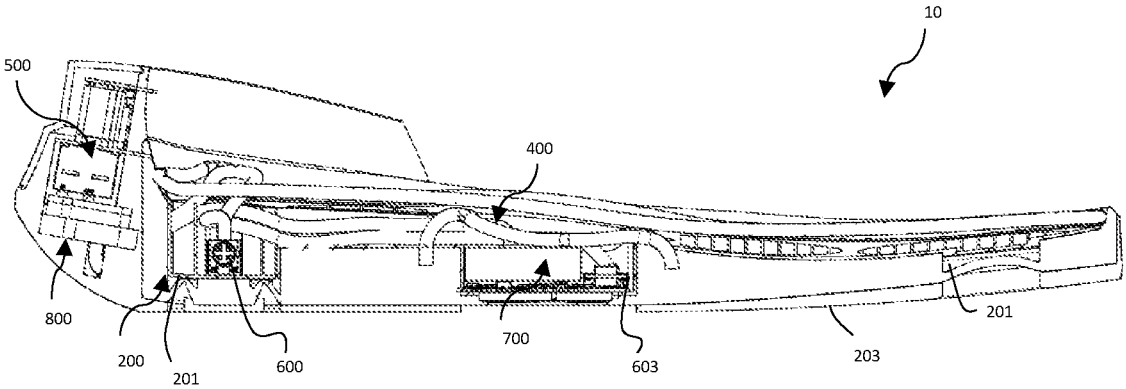
FIG. 11 shows a sectional view along the line A-A of the sole shown in FIG. 9.
Figure 12:
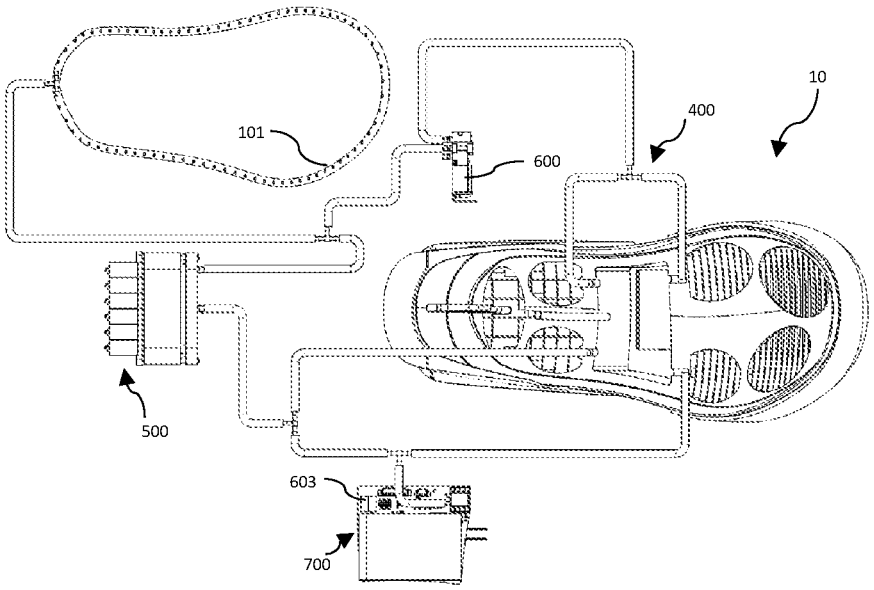
FIG. 12 shows an exploded schematic view of the sole shown in FIG. 9.
Figure 13:
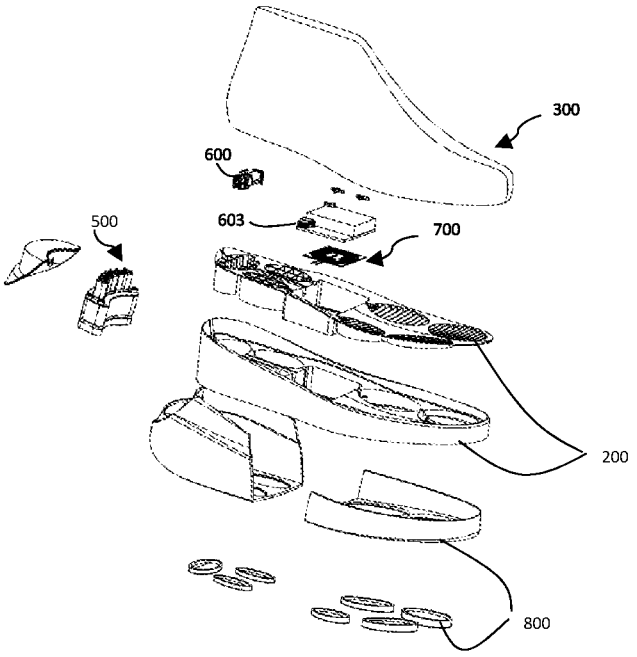
FIG. 13 shows an exploded schematic view of a footwear, without the first layer, according to an aspect of the present disclosure in a condition of direct ventilation.
Figure 14:
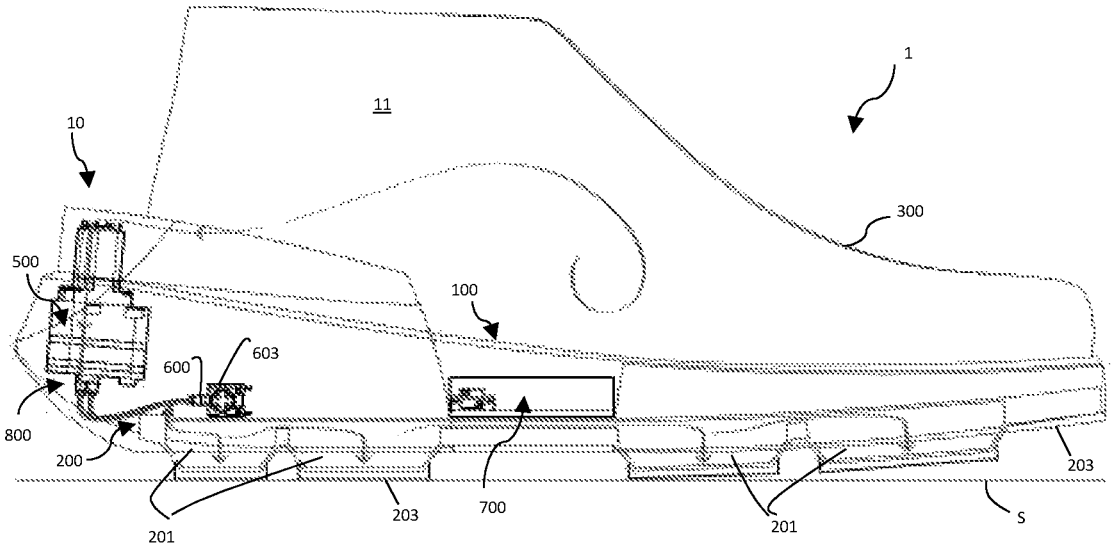
FIG. 14 shows a schematic sectional view of a footwear according to an aspect of the present disclosure in a condition of direct ventilation.
Figure 15:
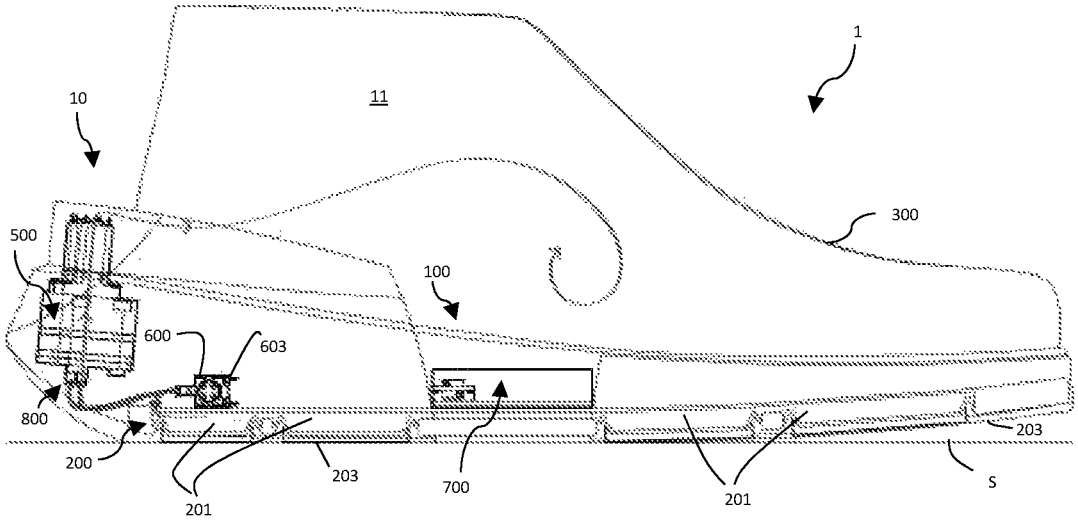
FIG. 15 shows a schematic sectional view of a footwear according to an aspect of the present disclosure in a condition of reverse ventilation.

With reference to the attached figures, an embodiment of a footwear sole is indicated with the reference number 10. In the context of present description the expression "footwear sole" indicates an element configured to be associated with a footwear, in particular to the outer upper portion, for example to an upper 300, of a footwear 1.

Again with reference to the attached figures, the footwear to which said sole 10 can be associated is generically indicated with the reference number 1.

According to the present disclosure, the sole 10 comprises a first layer 100 configured to be connected to an upper 300 of a footwear 1 to form an inner environment 11 of the footwear 1. Said inner environment 11 is the substantially closed space of the footwear 1 which space, in use, is apt to accommodate therein a user's foot.

In the context of the present disclosure, first layer 100 means the portion of sole 1 facing a user's foot and suitable, in use, to be placed in direct contact with the foot of that user. Said first layer 100 can therefore comprise only the portion of the sole located at the lying area of a user's foot, that is to say the inner sole or the footbed of a footwear 1, or it can also comprise the inner buttress, that is the portion apt to cover the user's calcaneus or heel.

According to the present disclosure, the first layer 100 comprises a plurality of through orifices 101 or openings. Therefore, when the first layer 100 is coupled to an upper 300, said plurality of through orifices 101, or through holes, allow the communication with the inner environment of the footwear 11.

According to a preferred aspect of the present disclosure, said plurality of orifices 101 is made at a perimetric region, i.e. peripheral or edge region, of the first layer 100. Even more preferably said orifices 101 are made at the perimetric region of the insole or the footbed. Alternatively, or in combination with the latter aspect, the first layer 100 comprises a grid element 102 provided with said plurality of orifices 101. Said grid element 102 can be housed or inserted into a suitable seat consisting of a through opening of the first layer 100 placed or made at a heel region of said first layer 100; in particular, the grid element 102 can be housed in the buttress or in the inner sole or the footbed of a footwear 1.

According to the present disclosure, the sole 10 further comprises a second layer 200 connected to the first layer 100. Said second layer 200, with respect to the first layer 100, is apt in use to face a walking surface S. The second layer 200 comprises a plurality of chambers 201. These chambers 201 constitute substantially hollow spaces within said second layer 200.

According to the present disclosure, one or more channels or passages 400 are also part of the sole 10, forming a fluid communication system, which fluidically connect said plurality of orifices 101 and said plurality of chambers 201 to each other. Put it differently, the multiple channels or passages 400 form a pneumatic path or circuit. It should also to be understood as a fluid communication system 400 wherein the fluid communication can be closed or interrupted even momentarily, as described below. The fluid communication system 400 is formed by the one or more channels or passages which extend between the plurality of orifices 101 and the plurality of chambers 201 to allow the fluid communication between them. In other words, through the one or more channels or passages 400 it is possible causing a fluid, such as air and/or water vapour, to flow or to pass between said plurality of orifices 101 and said plurality of chambers 201. Generally, hereinafter the present disclosure only refers to the passage of air between said plurality of orifices 101 and said plurality of chambers 201. However, it must be understood that in the air flow between the plurality of orifices 101 and the plurality of chambers 201, and vice versa, there is also of water vapour. In such way, hot air and sweat particles can be removed from the region close to a user's foot.

According to a preferred aspect, said one or more channels or passages 400 are also apt to connect each of the chambers of the plurality of chambers 201 together to at least one other chamber of the plurality of chambers 201. That is to say, the chambers 201 can in turn be interconnected and/or in fluid communication directly between them.

In addition, according to the present disclosure, the sole 10 comprises a pressurization device 500 connected to the one or more channels or passages 400 and configured to increase an air pressure in said plurality of chambers 201. The pressurization device 10 is apt to withdraw air through the plurality of orifices 101 and to supply such air to the plurality of chambers 201, increasing the pressure inside the latter ones. The pressurization device 500 is therefore to be understood as a supply device which conveys or supplies an air or fluid flow towards the plurality of chambers 201. In other words, the pressurization device 500 can be a device apt to suck the air within the plurality of chambers 201.

According to the present disclosure, the sole 10 further includes one or more regulating valves 600, in fluid communication with said one or more channels or passages 400. The one or more regulating valves 600 are i.e. connected or associated to the one or more channels or passages 400. Said one or more regulating valves 600 are configured to adjust a pressure within the plurality of chambers 201. In particular, the at least one regulating valve 600 is apt to regulate the air pressure inside the chambers 201. More precisely, the at least one regulating valve 600 is apt to adjust the air pressure inside the chambers 201 between a pressure equal to the atmospheric pressure and a pressure higher than the atmospheric pressure. Preferably, the one or more regulating valves 600 are on-off valves or shut-off valves. Preferably, that is, the one or more regulating valves 600 are configured to keep the plurality of chambers 201 at a predefined minimum pressure, equal to atmospheric pressure, or at a predefined maximum pressure, higher than atmospheric pressure. According to this preferred aspect, the one or more regulating valves 600 do not allow a fine adjustment of the air pressure within the plurality of chambers 201 but are, instead, configured to allow a complete closing or opening of the fluid communication between the plurality of chambers 201 and the one or more channels or passages 400. The one or more regulating valves 600 should be understood in the context of the present disclosure as means for adjusting the amount of air present within each chamber of the plurality of chambers 201, and consequently to define the pressure inside each of them.

According to an aspect of the present disclosure, the pressurization device 500 and said one or more regulating valves 600 are configured to control the air flow from said plurality of orifices 101 to said plurality of chambers 201 and vice versa, between a dynamic condition of ventilation and at least one static condition. That is to say that the pressurization device 500 and said one or more regulating valves 600 are configured to control and adjust an air passage between said plurality of orifices 101 and said plurality of chambers 201 and vice versa. Therefore, when the sole 10 according to the present disclosure is associated with an upper 300, the pressurization device 500 and said one or more regulating valves 600 are apt to allow an exchange of air between the inner environment 11 of the footwear 1 and said plurality of chambers 201 and between said plurality of chambers 201 and the inner environment 11.

In particular, said pressurization device 500 and said one or more regulating valves 600 are configured to determine a pressure imbalance between the pressure within the inner environment 11 of the footwear and the plurality of chambers 201 and to restore a pressure balance between the inner environment 11 of the footwear and the plurality of chambers 201.

More specifically, according to a preferred aspect of the present disclosure, the pressurization device 500 and said one or more regulating valves 600 are apt to adjust said air passage or flow between a dynamic ventilation condition, i.e. a dynamic condition wherein there is an air flow inside the sole 1 between the plurality of orifices 101 and the plurality of chambers 201 or vice versa, and at least one static condition, wherein an air flow or an air exchange or an air passage is substantially lacking between the plurality of orifices 101 and the plurality of chambers 201 or vice versa. In particular, in said dynamic ventilation condition, the pressurization device 500 and said one or more regulating valves 600 are configured to allow the passage or an air flow between said plurality of orifices 101 and said plurality of chambers 201 and vice versa; while, in said at least one static condition, the one or more regulating valves 600 are configured to prevent, or oppose or prevent or hinder, an air passage or flow between said plurality of chambers 201 and said plurality of orifices 101.

In particular, according to this preferred aspect, in the dynamic ventilation condition, the one or more regulating valves 600 can be completely open to allow fluid communication between the plurality of chambers 201 and the plurality of orifices 101. Preferably, in the condition of reverse ventilation, the pressurization device 500 is also configured to allow a return or passage of air from said plurality of chambers 201 to said plurality of orifices 101, or to not prevent such return. Conversely, according to this preferred aspect again, in the static condition, the one or more regulating valves 600 can be completely closed to prevent fluid communication between the plurality of chambers 201 and the plurality of orifices 101.

According to a preferred aspect, the dynamic ventilation condition can be a direct ventilation condition or a reverse ventilation condition.

In the direct ventilation condition, the one or more regulating valves 600 are configured to allow the passage of air and the pressurization device 500 is configured to generate an air flow from the orifices 101 to the plurality of chambers 201. The pressurization device 500 is apt to suck or withdraw air through said plurality of orifices 101 and to supply it, through the communication system 400 and the one or more regulating valves 600, to the plurality of chambers 201. The pressurization device 500 is therefore configured to withdraw air from the inner environment of the footwear 11, at a pressure equal to the atmospheric pressure, and transferring it within said plurality of chambers 201, increasing the pressure of the air in the chambers 201. In such condition of direct ventilation, the pressurization device 500 and the one or more regulating valves 600 are configured to create or generate a pressure difference or imbalance between the pressure inside the plurality of chambers 201 and the atmospheric pressure; that is, an imbalance or a difference in pressure between the plurality of chambers 201 and the inner environment 11 of the footwear 1. Preferably, said pressurization device 500 is configured to bring the air pressure inside the chambers up to a pressure of 1.5-4 bar, even more preferably up to a pressure of about 2.5 bar.

In the reverse ventilation condition, the one or more regulating valves 600 are configured to allow a return of air from said plurality of chambers 201 to said plurality of orifices 101. In other words, the one or more regulating valves 600 are configured to allow a discharge or expulsion of the air from the plurality of chambers 201 towards the plurality of orifices 101. Preferably, said discharged or said expulsion of air from the chambers 201 is a maximum or complete expulsion. In other words, preferably, in said reverse ventilation condition, the one or more regulating valves 600 are configured to allow a complete or maximum passage of air from said plurality of chambers 201 to said plurality of orifices 101. In particular, in the reverse ventilation condition, the pressurization device 500 is configured not to withdraw air through the plurality of orifices 101; that is, the pressurization device 500 is inactive. Preferably, as anticipated, in the condition of reverse ventilation, the pressurization device 500 is also configured to allow a return or passage of air from said plurality of chambers 201 to said plurality of orifices 101, or to not prevent such a return. Therefore, in this indirect ventilation condition, the pressurization device 500 and the one or more regulating valves 600 are configured to restore the pressure balance between the pressure inside the plurality of chambers 201 and the atmospheric pressure; that is to say to take the pressure within the plurality of chambers 201 back to the pressure within the inner environment 11 of the footwear 1, i.e. at atmospheric pressure.

According to a preferred aspect, the at least one static condition is a first static condition, wherein a fluid communication between the chambers 201 and the orifices 101 is lacking. In such static condition, the pressurization device 500 is configured not to withdraw air through the plurality of orifices 101; that is, the pressurization device 500 is inactive. Said one or more regulating valves 600 are configured to prevent a return of air from said plurality of chambers 201 to said plurality of orifices 101. That is to say that, in said first static condition, the air present within the plurality of chambers 201 cannot pass through the one or more channels or passages 400 to reach the plurality of orifices 101. In even other words, in said first static condition, a discharge or an escape of air from the plurality of chambers 201 to the plurality of orifices 101 is hindered or prevented. In such first static condition, the chambers 201 keep the pressure, and said one or more regulating valves 600 are closed and cause an interruption of the fluid communication. Therefore, in said first static condition, an imbalance or a pressure difference is kept between the pressure inside the plurality of chambers 201 and the atmospheric pressure; that is, an imbalance or a pressure difference between the plurality of chambers 201 and the inner environment 11 of the footwear 1. In particular, the plurality of chambers 201 is either found or kept at a pressure higher than the atmospheric pressure. Preferably, in this first static condition, the plurality of chambers 201 is at a pressure of about 1.5-4 bar; even more preferably at a pressure of about 2.5 bar. Furthermore, in the first static condition, the pressurization device 500 is configured not to withdraw air through the plurality of orifices 101; that is, the pressurization device 500 is inactive.

According to a preferred aspect, a further static condition, or second static condition, is also possible. In this second static condition, there is a pressure balance between the plurality of chambers 201 and the atmospheric pressure; that is, the pressure within the chambers 201 equals the atmospheric pressure. In the second static condition, therefore, the plurality of chambers 201 is at the same pressure as the inner environment 11 of the footwear. In the second static condition, since the chambers 101 do not need to keep the pressure, said one or more regulating valves 600 are configured to be fully open and cause complete fluid communication while the pressurization device 500 is configured not to withdraw air through the plurality of orifices 101; that is, the pressurization device 500 is inactive. The chambers 201 are therefore completely emptied.

According to a further preferred aspect, the plurality of chambers 201 are expandable chambers, or expansion chambers, apt to determine a determined configuration of the second layer 200. In particular, the increase in volume of the chambers caused by the air flow inside them, and the consequent pressure increase, causes a deformation of the same second layer 200 such that a plurality of asperities, protrusions or bulges are present or formed, at each of said chambers 201.

In particular, according to this preferred aspect, in said first static condition, the plurality of chambers 201 has a first volume v1 and while in said second static condition the plurality of chambers 201 has a second volume v2, smaller than said first volume v1. In other words, in said first static condition, the plurality of chambers 201 is in or reaches an inflated configuration, while in said second static condition the plurality of chambers 201 is in or reaches a deflated configuration.

For example, the first volume v1 can be reached when the pressure within the plurality of chambers 201 reaches a predefined maximum pressure and the volume v2 can be reached when the plurality of chambers 201 reaches the atmospheric pressure. Both the first volume v1 and the second volume v2 can be known in advance or can be calculated according to techniques known to a person skilled in the art, and consequently the average time necessary for the plurality of chambers 201 to pass from the first volume v1 to the second volume v2 and/or vice versa can be calculated.

According to a preferred aspect, the sole 10 also has a support surface 203 apt, in use, to be placed towards, or placed in contact with, a walking surface S. Said support surface 203 is therefore a surface, which in use it is opposite the surface the user's foot is in contact with. Preferably, the second layer 200 defines at least part of said support surface 203 or is capable of causing a change in the morphology or shape of said support surface 203. The second layer 200 is the layer of the sole 10 which rests on the ground, or it is part of or is partially integrated in a third layer 800 of the sole which rests on the ground. In other words, the supporting surface 203 is formed integrally by the second layer 200, or it is formed in part by said second layer 200 and by said third layer 800. Alternatively, the second layer 200 is covered by the third layer 800; which defines said support surface 203. In particular, in said second static condition, said support surface 203 is substantially flattened or flat. That is to say that when the chambers 201 are not under pressure, i.e. they are at a pressure equal to the atmospheric pressure, said chambers 201 determine an almost flattened or flat conformation of the supporting surface 203. Instead, in said first static condition, the surface of support 203 has or forms an asperity or protuberance or bulges at each chamber of said plurality of chambers 201. In other words, when the chambers 201 are under pressure, i.e. they are at a pressure higher than atmospheric pressure, said chambers 201 determine a three-dimensional conformation of the support surface 203. Preferably, said asperities or protuberances or bulges protrude in a direction facing the walking surface S. In other words, the asperities or protuberances or bulges, in use, protrude towards said walking surface S. Again said in different words, preferably, the asperities or protuberances or bulges substantially form studs on the bearing surface 203.

According to a particular preferred aspect of the present disclosure, the chambers 201 are made at a first end region of the second layer 200 and a second end region of the second layer 200, opposite to said first end region. In other words, the chambers 201 are distributed at a first end region of the sole 10 and a second end region of the sole 10. Preferably, said first end region and said second end region of the sole 10, and consequently the second layer 200, correspond to a heel region and a toe region. Alternatively, the chambers of the plurality of chambers 201 can be made at a central region of the sole 10 and a peripheral region of the sole 10, which surrounds said central region.

According to this same aspect, said one or more regulating valves 600 comprise a first valve 601 and a second valve 602, configured to allow or prevent the fluid communication between the plurality of orifices 101 and each chamber 201 of the plurality of chambers respectively in the first end region of the sole 10 and in the second end region of the sole 10 via the aforementioned fluid communication system 400. Therefore, the first valve 601 is configured to allow or not the fluid communication with a first compartment or group of chambers 201, while the second valve is configured to allow or not fluid communication with a second compartment or group of chambers 201. In other words, the first valve 601 adjusts the pressure within the chambers located in the first end region and, likewise, the second valve 602 adjusts the pressure within the chambers located in the second end region. It follows that it is possible to activate or operate the first valve 601 and the second valve 602 separately or separately; in this way it is possible to create a difference in the dynamic or static condition of ventilation between said two groups of chambers 201.

According to a preferred aspect of the present disclosure, the pressurization device 500 and/or the one or more regulating valve 600 are mechanical members that can be activated manually by a user. Alternatively, the pressurization device 500 and/or the one or more regulating valve 600 are electronic devices. Preferably, both the pressurization device 500 and the one or more regulating valve 600 are electronic devices.

Possible examples of pressurization devices 500 are: volumetric compressors, rotary compressors, peristaltic pumps, electromechanical pumps, manual pumps. Possible examples of regulating valves 600 are: solenoid valves, such as electronically controlled pinch valves or electronically controlled duckbill valves. According to a further preferred aspect, the sole 10 comprises a time switch or timer (not shown in the figures) connected to the one or more regulating valves 600 and/or to the pressurization device 500. The timer is configured or programmed to control the opening/closing of the one or more regulating valves 600 at predetermined time intervals; alternatively or in combination with this aspect, the time switch or timer is configured or programmed to control the activation of the pressurization device 500 at predetermined time intervals. The time switch or timer can be mechanical, electrical or electronic. According to a further preferred aspect, the sole 10 comprises a control unit 700. The control unit is connected to the one or more regulating valve 600 and is configured or programmed to control the closing and/or opening of said valves. one or more regulating valves 600; alternatively or in combination with this aspect, the control unit 700 is connected to the pressurization device 500 and is apt to control the activation of the latter. In other words, the pressurization device 500 is activated according to a command sent to it by the control unit 700. In other words, the control unit 700 can also be configured or programmed to activate or deactivate the pressurization device 500. In particular, the control unit 700 is, for example, apt to interrupt the operation of the pressurization device 500 upon reaching a threshold pressure within the plurality of chambers 201. For example, the control unit 700 can comprise a time switch or timer for controlling the opening/closing of the at least one regulating valve 600 and/or the activation of the pressurization device 500 at predefined or predetermined time intervals. These time intervals are preferably fixed or regular or of the same duration. In this way, by means of the time switch or timer, the plurality of chambers 201 can be discharged at regular time intervals. As said above, knowing, for example, the average amount of time necessary for the chambers 201 to reach the first volume v1, the plurality of chambers 201 can therefore be discharged regularly upon reaching this first volume v1. Further or alternatively, the fluid communication with the plurality of chambers 201 can be closed at regular time intervals. As mentioned above, knowing, for example, the average amount of time necessary for the chambers 201 to reach the first volume v1, the flow of further air to the plurality of chambers 201 can be prevented, thus avoiding the achievement of a volume greater than the first volume v1.

According to a preferred aspect of the present disclosure, the sole 10 also comprises a pressure sensor 603, apt to detect a pressure within the plurality of chambers 201. According to this same preferred aspect, said pressure sensor 602 is connected to the control unit. The control unit 700 is configured or programmed to control the closing and/or opening of said one or more regulating valves 600 if the pressure detected by the pressure sensor 603 reaches a certain pressure threshold. That is to say that the control unit 700 is configured to control the activation of one or more regulating valves 600 according to the reaching of a certain threshold or pressure limit within the chambers 201. In this way, upon reaching the predetermined pressure threshold, within the chambers 201, the fluid communication between the plurality of chambers 201 and the plurality of orifices can be selectively allowed or prevented. It follows that upon reaching a certain pressure threshold, for example the aforementioned predefined maximum pressure, the plurality of chambers 201 can be discharged or the inflow of further air to the plurality of chambers 201 can be prevented in order to therefore avoid reaching a volume greater than the first volume v1. According to a preferred aspect of the present disclosure, the sole 10 comprises a first pressure sensor 603*a* and a second pressure sensor 603*b*, respectively apt to detect a pressure within a first group of chambers and within a second group of chambers 201 and connected to the control unit 700. The fluid communication with the first group of chambers 201 and with the second group of chambers 201 is open or closed depending on the state of a first regulating valve 601 and a second regulating valve 602 respectively. According to this same preferred aspect, the control unit 700 is configured or programmed to control the closing or opening of said first regulating valve 601 if the pressure detected by the first pressure sensor 603*a* reaches a certain pressure threshold and, similarly, the control unit 700 is configured or programmed to control the closing or opening of said second regulating valve 602 if the pressure detected by the second pressure sensor 603*b* reaches a certain pressure threshold. That is, the control unit 700 is configured to separately or selectively control the activation of the first regulating valve 601 and the second regulating valve 602 according to the reaching of a certain threshold or pressure limit within the first group of chambers 201 and within the second group of chambers 201.

Preferably said pressure sensor 603, 603*a* or 603*b* is a pressure switch. Preferably, said pressure threshold is equal to about 1.5-4 bar, even more preferably about 2.5 bar. This pressure threshold can correspond to the aforementioned predefined maximum pressure.

According to a preferred aspect of the present disclosure, the pressurizing device 500 is positioned at an end region of the sole 10, such as for example a heel region. In this way, the pressurization device 500 is less of a hindrance when walking or performing other activities and, if its activation is manual, it is also easily accessible for a user. Alternatively, according to a different preferred aspect, the pressurization device 500 is positioned at a region of the waist edge of the sole 10. Preferably, moreover, if present, also the at least one pressure sensor 603 and the control unit 700 are housed within the second layer 200. The second layer 200 can therefore comprise a housing or seat for the pressure sensor 603 and for the control unit 700. Even more preferably, the control unit 700 is located in a waist edge region of the second layer 200.

According to a preferred aspect, the sole 10 comprises a further layer. Said further layer is a third layer 800, coupled to the second layer 200 of the latter. Preferably, the third layer 800 covers at least partially the second layer 200 and forms completely or partially the resting surface 203 of the sole 10. Even more preferably, said pressurization device 500 is housed within the third layer 800. Preferably said third layer 800 has a housing for the pressurization device 500 at an end region. Even more preferably, the pressurization device 500 is contained in a housing of the third layer 800 made in a heel region or buttress region of the sole 10.

According to a preferred aspect of the present disclosure, the sole 10 further comprises a temperature sensor 901 and/or a humidity sensor 902. Said temperature sensor 901 and/or the humidity sensor 902 are associated with the first layer 100. In this way, when the sole 10 is coupled to an upper 300, the temperature sensor 901 and/or the humidity sensor 902 are exposed to the inner environment 11 of the footwear 1. The temperature sensor 901 and/or the humidity sensor 902, in operation, are therefore apt respectively to detect or measure the temperature and humidity of the inner environment 11 of the footwear 1. Said temperature sensor 901 and/or a humidity sensor 902 are connected to the control unit 700. According to this preferred aspect, the control unit 700 is programmed or configured to activate the pressurization device 500 upon reaching a certain temperature and/or humidity threshold. Therefore, the control unit 700 is programmed or configured to activate the pressurization device if a certain temperature and humidity value and/or a threshold is reached within the inner environment 11 of the footwear 1. According to this same preferred aspect, moreover, the control unit 700 can be connected to the at least one regulating valve 600 and be configured so as to control the opening or closing of the latter one/ones depending on the temperature and/or humidity reached within the inner environment 11. In particular, the control unit 700 can be configured to open or close the at least one regulating valve 600 once the aforementioned temperature and/or humidity threshold has been reached within inner environment 11. That is to say that the control unit 700 can be configured to allow or not a fluid communication between the plurality of chambers 201 and the plurality of orifices 101 depending on the temperature and/or humidity in the inner environment 11. The present disclosure also relates to a footwear 1 comprising a sole 10 according to one or more of the aspects described up to here. The footwear 1 also comprises an upper 300 associated with the first layer 100 of the sole 10 so as to define an inner environment 11 of the footwear 10. Preferably, the footwear 1 comprises a temperature sensor 901 and/or a humidity sensor 902 coupled to the upper 300. The temperature sensor 901 and/or the humidity sensor 902 are configured to detect or measure, respectively, the temperature and humidity within the inner environment 11 of the footwear 1. The temperature sensor 901 and/or the sensor 902 are therefore connected to the control unit 700. The latter 700 is also configured to control the operation, in particular to determine the activation, of the pressurization device 500. More specifically, the control unit 700 is configured or programmed to determine or control the activation of the pressurization device 500 upon reaching a certain, i.e. predefined, temperature threshold and/or a certain s oglia of humidity. Preferably, moreover, the control unit 700 can also be connected to the at least one regulating valve 600 and be configured so as to control the opening or closing of the latter depending on temperature and/or humidity detected by the temperature sensor 901 or by the humidity sensor 902 respectively. In particular, the control unit 700 can be configured to open or close the at least one regulating valve 600 once the aforementioned temperature and/or humidity threshold within the inner environment 11 is reached.

A further subject matter of the present disclosure has as a method for ventilating the inner environment of a footwear.

In describing this process, the elements of the sole 10 and of the footwear 1 involved in the method and having the same function and the same structure as the previously described elements retain the same reference number and are not again described in detail.

According to the present disclosure, the method for ventilating the inner environment 11 of a footwear 1 comprises a step of preparing an upper 300, preparing a first layer 100 of sole 10, having a plurality of through orifices 101, and applying or associating or connecting said first layer 100 to said upper to form the inner environment 11. In addition, the method according to the present disclosure provides for providing a second layer 200 of sole 10, comprising a plurality of chambers 201 and coupling said second layer 200 to said first layer 100. Preferably, said second layer 200 is coupled to the first layer 100 on the opposite side with respect to the upper 300. Therefore, the method further provides fluidically connecting said plurality of orifices 101 and said plurality of chambers 201 through one or more several channels or passages 400 between said plurality of orifices 101 and said plurality of chambers 201. In other words, the method provides for the making a system of fluid communication between the plurality of orifices 101 and the plurality of chambers 201. The method further provides providing a pressurizing device 500, put said pressurizing device 500 in fluid communication with said one or more channels or passages 400, providing a or more regulating valves 600 and put said one or more regulating valves 600 in fluid communication with said one or more channels or passages 400. Finally, the method provides for generating and adjusting an air passage or flow between said plurality of orifices 101 and said plurality of chambers 201 and vice versa. That is to say that according to the aforesaid method it is created an air flow which flows, or passes, in a first direction between the plurality of orifices 101 and the plurality of chambers 201 or in a second direction, opposite to the first direction, between the plurality of chambers 201 and the plurality of orifices 101. In the first case, it is generated and adjusted an air flow moving away from or exiting the inner environment 11 of the footwear 1, while in the second case an air flow is created and adjusted entering the inner environment 11 of the footwear. In the first case a direct ventilation condition is created while in the second case a reverse ventilation condition is created.

According to a preferred aspect, the step creating an air passage or flow between said plurality of orifices 101 and said plurality of chambers 201 or vice versa comprises: sucking air through said plurality of orifices 101 by means of said pressurization device 500, supplying said air through said one or more channels or passages 400 and said one or more regulating valves 600 to the plurality of chambers 201, increasing the air pressure within said plurality of chambers 201, preventing a return of air through said one or more regulating valves 600, allowing a return or passage of air through said one or more regulating valves 600 towards the plurality of orifices 101. In other words, the generation of an air flow comprises sucking a certain amount of air from the inner environment of the footwear, by means of the pressurization device 500, supply said quantity of air to the plurality of chambers 201 until an increase in the pressure of air within the chambers 201 is obtained and blocking, by means of the at least one regulating valve 600, the fluid communication between the plurality of chambers 201 and the plurality of orifices 101 and thus allowing the fluid communication between the plurality of chambers 201 and the plurality of orifices 101. Still said differently, up to the step of increasing the pressure in the plurality of chambers 201, an air flow is generated in the direction between the plurality of orifices 101, hence the inner environment of the footwear, and said plurality of chambers 201. While, in the phase of return or passage of air through said one or more regulating valves 600 towards the plurality of orifices 101, an air flow is generated, in the direction between the plurality of chambers 201 and the plurality of orifices 101.

Furthermore, according to a further preferred aspect according to the present disclosure, in the return or passage of air through said one or more regulating valves 600, the return or passage is a complete or maximum passage of air from said plurality of chambers 201 to said plurality of orifices 101. In other words, the plurality of chambers 201 empties completely. The one or more regulating valves 600 are completely open to allow complete venting or deflation of the plurality of chambers. In addition according to a preferred aspect of the present disclosure, the method further comprises the steps of: measuring the time, opening and/or closing the at least one regulating valve 600 at predetermined time intervals and/or controlling the activation of the device of pressurization 500 at pre-established time intervals. In other words, the method may provide that after a predetermined time period, the one or more regulating valves 600 are open or closed and/or that the pressurization device 500 is activated or deactivated. The predetermined time interval can be equal to the time required for the plurality of chambers 201 to reach a predefined or predetermined maximum pressure or a predefined or predetermined maximum volume.

According to a further preferred aspect of the present disclosure, the method further comprises the steps of: detecting a pressure within the plurality of chambers 201, defining a pressure threshold, controlling the closing and/or opening of the at least one regulating valve 600 if the detected pressure reaches this specific pressure threshold. In addition, according to this preferred aspect, the method can also comprise the step of controlling the activation of the pressurization device 500 depending on the measured pressure. In particular, this phase may include the activation or deactivation of the pressurization device 500 upon reaching the aforementioned pressure threshold. According to this preferred aspect, therefore, the method involves measuring or monitoring the pressure within the plurality of chambers 201 and adjusting the air flow and humidity to/from the latter.

According to a further preferred aspect of the present disclosure, the method further comprises the steps of: detecting the temperature and/or humidity within the inner environment 11 of the footwear, defining a temperature and/or humidity threshold, controlling the activation of the pressurization device 500 and/or open or close the at least one regulating valve 600 upon reaching a predetermined temperature and/or humidity threshold. According to this preferred aspect, therefore, the method involves measuring or monitoring the temperature and/or humidity within the inner environment 11 and adjusting the air flow and humidity to/from the plurality of chambers 201.

The subject-matter of the present disclosure has been described hitherto with reference to its embodiments. It is to be understood that other embodiments relating to the same inventive idea may exist, all of these falling within the protection scope of the claims which are illustrated hereinbelow.

Any variations or additions can be made by those skilled in the art to the embodiments described and illustrated here, remaining within the scope of the following claims. In particular, further embodiments may include the technical characteristics of one of the following claims with the addition of one or more technical characteristics described in the text or illustrated in the drawings, taken individually or in any reciprocal combination.

The invention claimed is:

1. A sole for footwear, the sole comprising:

a first layer having a plurality of through orifices and configured to be connected to an upper of a footwear and to form an inner environment of the footwear;

a second layer coupled to said first layer and comprising a plurality of chambers;

one or more channels or passages fluidly connecting said plurality of orifices and said plurality of chambers;

a pressurization device in fluid communication with said one or more channels or passages and configured to increase an air pressure in said plurality of chambers; and one or more regulating valves in fluid communication with said one or more channels or passages and configured to adjust a pressure in said plurality of chambers;

wherein said pressurization device and said one or more regulating valves are configured to control the flow of air from said plurality of orifices to said plurality of chambers and vice versa, between a dynamic ventilation condition and at least one static condition;

wherein in said dynamic ventilation condition, said pressurization device and said one or more regulating valves are configured to allow the passage of air between said plurality of orifices and said plurality of chambers and vice versa; and wherein in said at least one static condition, said one or more regulating valves are configured to prevent or hinder a passage of air between said plurality of chambers and said plurality of orifices;

wherein in said at least one static condition there is a first static condition; and in said first static condition, the pressure inside the plurality of chambers is greater than the atmospheric pressure; and wherein said pressurization device and said one or more regulating valves are configured to control the air flow from said plurality of orifices to said plurality of chambers and vice versa, between the dynamic ventilation condition and a second static condition, wherein in said second static condition, the pressure inside the plurality of chambers is substantially equal to the atmospheric pressure; and wherein in said first static condition, the plurality of chambers has a first volume (v1) and wherein, in said second static condition, the plurality of chambers has a second volume (v2), wherein said second volume (v2) is smaller than said first volume (v1).

2. The sole according to claim 1, wherein said dynamic ventilation condition is a direct ventilation condition; wherein, in said direct ventilation condition, said pressurization device is configured to suck air through said plurality of orifices and supply the air to the plurality of chambers and said one or more regulating valves are configured to allow the passage of air from said plurality of orifices to said plurality of chambers.

3. The sole according to claim 1, wherein said dynamic ventilation condition is a reverse ventilation condition, wherein, in said reverse ventilation condition, said one or more regulating valves are configured to allow a complete or maximum passage of air from said plurality of chambers to said plurality of orifices.

4. The sole according to claim 1, further comprising a support surface, to face or be placed in contact with a walking surface (S) and wherein said second layer defines at least part of said support surface and wherein, in said second static condition, said support surface is substantially flat, and wherein in said first static condition said support surface has or forms, at each chamber of said plurality of chambers, a bulge which in use protrudes towards said walking surface (S).

5. The sole according to claim 1, wherein the chambers of said plurality of chambers are distributed at a first end region of the sole and at a second end region of the sole and wherein said one or more regulating valves comprise a first valve configured to open or close the fluid communication between said one or more channels or passages and each chamber of the plurality of chambers in the first end region of the sole, and a second valve configured to open or close the fluid communication between said one or more channels or passages and each chamber of the plurality of chambers in the second end region of the sole.

6. A sole for footwear, the sole comprising:

a first layer having a plurality of through orifices and configured to be connected to an upper of a footwear and to form an inner environment of the footwear;

a second layer coupled to said first layer and comprising a plurality of chambers;

one or more channels or passages fluidly connecting said plurality of orifices and said plurality of chambers;

a pressurization device in fluid communication with said one or more channels or passages and configured to increase an air pressure in said plurality of chambers; and one or more regulating valves in fluid communication with said one or more channels or passages and configured to adjust a pressure in said plurality of chambers;

the sole further comprising a timer connected to said one or more regulating valves and/or to said pressurization device, wherein said timer is configured or programmed to control the opening/closing of said one or more regulating valves at predetermined time intervals and/or to control the activation of said pressurization device at predetermined time intervals.

7. The sole according to claim 6, wherein said pressurization device is positioned at an end region of the sole.

8. A sole for footwear, the sole comprising:

a first layer having a plurality of through orifices and configured to be connected to an upper of a footwear and to form an inner environment of the footwear;

a second layer coupled to said first layer and comprising a plurality of chambers;

one or more channels or passages fluidly connecting said plurality of orifices and said plurality of chambers;

a pressurization device in fluid communication with said one or more channels or passages and configured to increase an air pressure in said plurality of chambers; and one or more regulating valves in fluid communication with said one or more channels or passages and configured to adjust a pressure in said plurality of chambers;

the sole further comprising a pressure sensor for detecting the pressure within the plurality of chambers, and a control unit connected to said pressure sensor and to said one or more regulating valves, wherein said control unit is configured or programmed to control the closure and/or the opening of said one or more regulating valves if the pressure detected by the pressure sensor reaches a certain pressure threshold.

9. The sole according to claim 8, wherein said control unit is connected to said pressurization device and is configured or programmed to activate said pressurization device.

10. The sole according to claim 8, further comprising a temperature sensor and/or a humidity sensor associated with said first layer for measuring respectively a temperature and/or a humidity within said inner environment, wherein said temperature sensor and/or said humidity sensor are connected to the control unit, and the control unit is programmed or configured to activate the pressurization device upon reaching a certain temperature threshold and/or humidity threshold.

* * * * *